US007862442B2

(12) United States Patent
Tseng

(10) Patent No.: US 7,862,442 B2
(45) Date of Patent: Jan. 4, 2011

(54) ADJUSTABLE SWING DEVICE

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 92 days.

(21) Appl. No.: 12/434,937

(22) Filed: May 4, 2009

(65) Prior Publication Data

US 2010/0279783 A1 Nov. 4, 2010

(51) Int. Cl.
*A63G 9/12* (2006.01)
*A63G 9/00* (2006.01)

(52) U.S. Cl. ..... 472/118; 472/125; 297/273; 5/125

(58) Field of Classification Search ..... 472/118–125; 297/273, 274, 281, 285, 353, 354.12, 354.13, 297/374; 5/124–126
See application file for complete search history.

(56) References Cited

U.S. PATENT DOCUMENTS 6,348,005 B1 * 2/2002 Tseng ..... 472/118
6,648,768 B1 * 11/2003 Tseng ..... 472/118
6,802,783 B1 * 10/2004 Tseng ..... 472/118
6,827,650 B1 * 12/2004 Tseng ..... 472/125
6,857,701 B1 * 2/2005 Liu ..... 297/281
6,935,962 B1 * 8/2005 Tseng ..... 472/125
7,037,205 B1 * 5/2006 Bowman ..... 472/118
7,367,895 B2 * 5/2008 Tseng ..... 472/118

* cited by examiner

*Primary Examiner*—Kien T Nguyen
(74) *Attorney, Agent, or Firm*—Trop, Pruner & Hu, P.C.

(57) ABSTRACT

A swing device comprises a stationary seat and a swinging mechanism. The stationary seat includes a pair of side frames, and a top frame interconnecting the side frames. The swinging mechanism includes a frame body unit swingable between the side frames and including front and rear frame bodies that are interconnected telescopically and that are locked releasably on each other, and a suspending unit including a pair of front swinging rods for connecting the front frame body swingably to the top frame of the stationary seat, and a pair of rear swinging rods for connecting the rear frame body swingably to the top frame of the stationary seat. Each of the rear swinging rods includes upper and lower tubes that are interconnected telescopically and that are locked releasably on each other.

9 Claims, 8 Drawing Sheets

ADJUSTABLE SWING DEVICE

BACKGROUND OF THE INVENTION

1. Field of the Invention

This invention relates to a swing device, and more particularly to a swing device that includes a backrest portion adjustable between a horizontal position and an inclined position.

2. Description of the Related Art

A conventional swing device includes a stationary seat, a seat member having a seat portion and a backrest portion that is adjustable between a horizontal position and an inclined position, and a pair of left and right suspending units for suspending the seat member on the stationary seat.

Typically, one of the seat portion and the backrest portion is formed with a row of positioning teeth defining a plurality of grooves, and the other of the seat portion of the backrest portion is formed with a tongue engaging a selected one of the grooves. As such, the seat portion and the backrest portion are interconnected by a tongue and groove joint.

SUMMARY OF THE INVENTION

The object of this invention is to provide a swing device including a seat member having a seat portion and a backrest portion that are interconnected by a connecting structure other than a tongue and groove joint.

According to this invention, a swing device comprises a stationary seat and a swinging mechanism. The stationary seat includes a pair of side frames, and a top frame interconnecting the side frames. The swinging mechanism includes a frame body unit swingable between the side frames and including front and rear frame bodies that are interconnected telescopically and that are locked releasably on each other, and a suspending unit including a pair of front swinging rods for connecting the front frame body swingably to the top frame of the stationary seat, and a pair of rear swinging rods for connecting the rear frame body swingably to the top frame of the stationary seat. Each of the rear swinging rods includes upper and lower tubes that are interconnected telescopically and that are locked releasably on each other.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
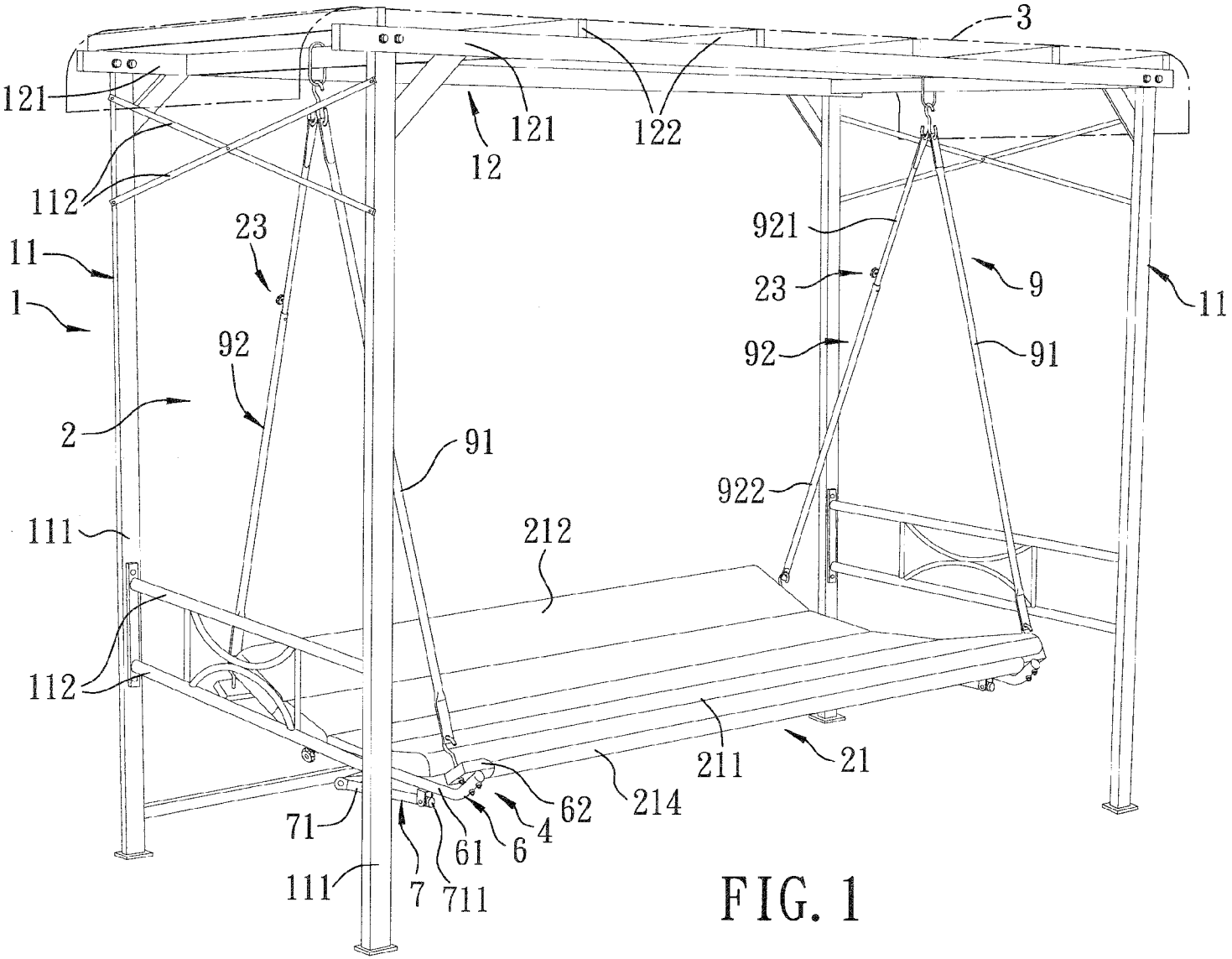
FIG. 1 is a perspective view of the preferred embodiment of an adjustable swing device according to this invention.
Figure 2:
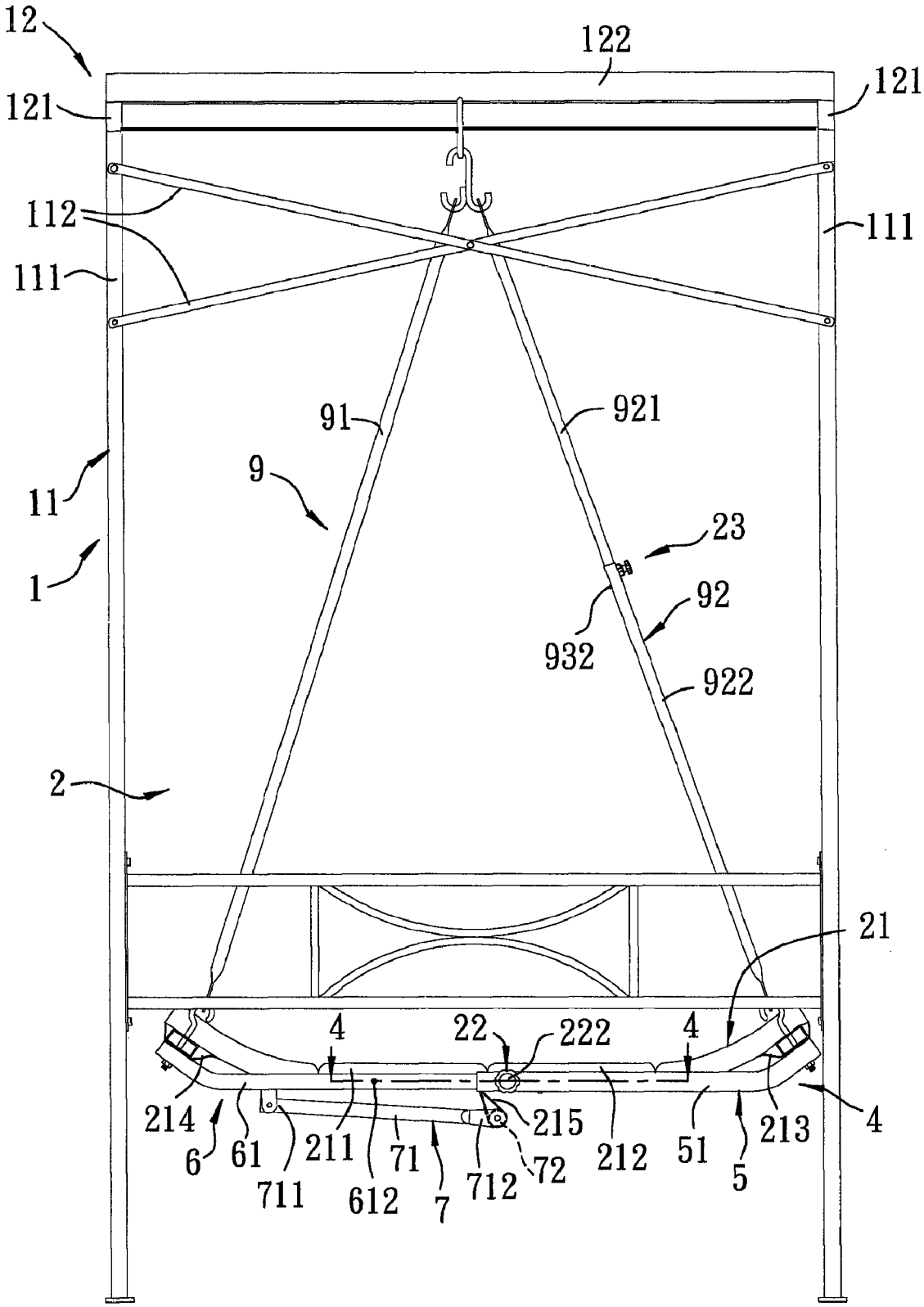
FIG. 2 is a side view of the preferred embodiment, illustrating a swinging mechanism in a first state.
Figure 3:
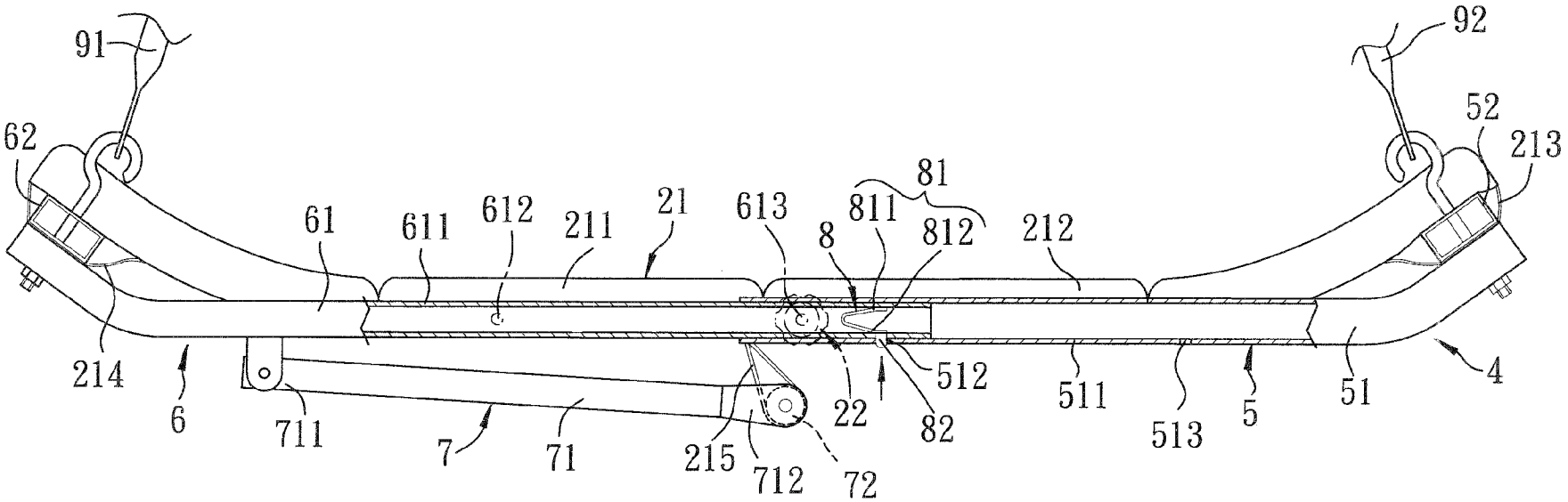
FIG. 3 is a fragmentary, partly sectional side view of the preferred embodiment, illustrating the swinging mechanism in the first state.

Referring to FIGS. 1, 2, and 3, the preferred embodiment of an adjustable swing device according to this invention includes a stationary seat 1, a swinging mechanism 2 swingable relative to the stationary seat 1, and a covering 3 disposed on an upper end of the stationary seat 1.

The stationary seat 1 includes a pair of side frames 11 spaced apart from each other in a left-to-right direction, and a top frame 12 interconnecting upper ends of the side frames 11. Each of the side frames 11 includes two upright rods 111 standing on the ground and spaced apart from each other in a front-to-rear direction, and a plurality of side connecting rods 112 for interconnecting the upright rods 111. The top frame 12 includes two transverse rods 121 each extending in the left-to-right direction for interconnecting upper ends of two corresponding ones of the upright rods 111, and a plurality of top rods 122 each extending in the front-to-rear direction and connected between the transverse rods 121. As such, the weight of the top frame 12 is less than that of a conventional solid top plate when the top frame 12 is replaced with the solid top plate. Furthermore, the material of the top frame 12 is reduced. That is, the manufacturing costs of the swing device can be reduced.

The swinging mechanism 2 includes a frame body unit 4 swingable between the side frames 11, a seat member 21, two first locking units 22 disposed on the frame body unit 4, a suspending unit 9 for suspending the frame body unit 4 between the side frames 11, and two second locking units 23 disposed on the suspending unit 9. The frame body unit 4 includes a front frame body 6, a rear frame body 5 connected telescopically to the front frame body 6, a pivotable frame body 7 connected to the front frame body 6, and two first positioning members 8 for positioning the front and rear frame bodies 6, 5 relative to each other.

Figure 4:
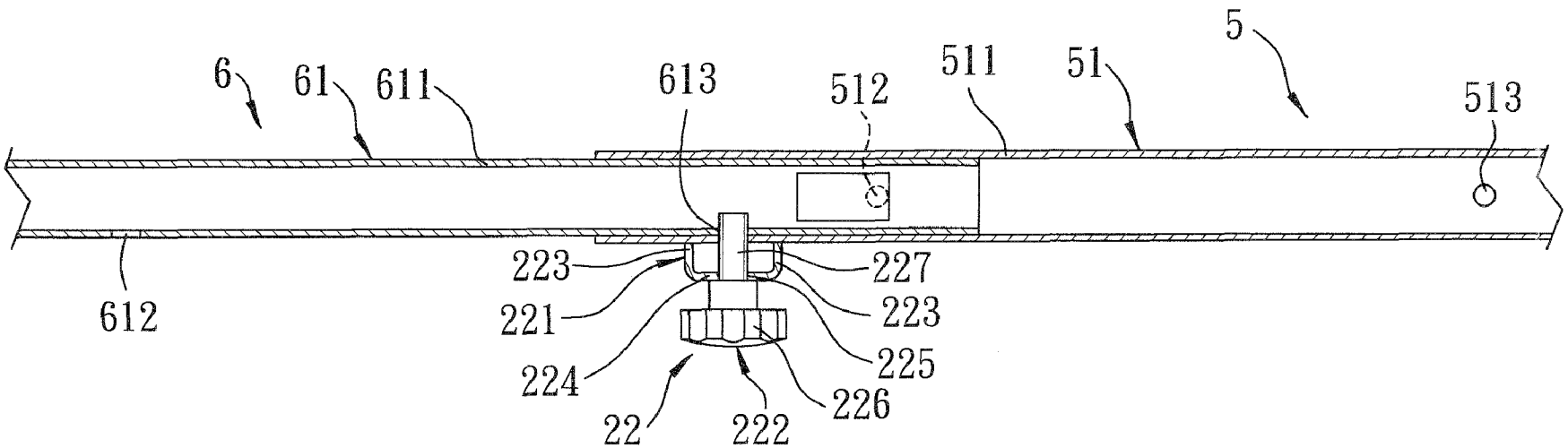
FIG. 4 is a sectional view taken along line 4-4 in FIG. 2.

With further reference to FIG. 4, the front frame body 6 includes a pair of front lateral tubes 61 extending in the front-to-rear direction and spaced apart from each other in the left-to-right direction, and a front connecting tube 62 extending in the left-to-right direction for interconnecting front ends of the front lateral tubes 61. Each of the front lateral tubes 61 has an annular wall 611, a front through hole 612, and a rear through hole 613 that is spaced apart from the front through hole 612 in an axial direction of the corresponding front lateral tube 61.

The rear frame body 5 includes a pair of rear lateral tubes 51 extending in the front-to-rear direction and spaced apart from each other in the left-to-right direction, and a rear connecting tube 52 extending in the left-to-right direction for interconnecting rear ends of the rear lateral tubes 51. The rear lateral tubes 51 are sleeved respectively and movably on the front lateral tubes 61. Each of the rear lateral tubes 51 has an annular wall 511, a front positioning hole 512, and a rear positioning hole 513 that is spaced apart from the front positioning hole 512 in an axial direction of the corresponding rear lateral tube 51 by a distance that is equal to that between the front and rear through holes 612, 613.

The pivotable frame body 7 is connected to the front frame body 6, and includes a pair of pivotable tubes 71 extending in the front-to-rear direction and spaced apart from each other in the left-to-right direction, and a middle connecting tube 72 extending in the left-to-right direction for interconnecting the pivotable tubes 71. Each of the pivotable tubes 71 has a pivot end 711 connected pivotally to the corresponding front lateral tube 61, and a non-pivot end 712 opposite to the pivot end 711 and connected to the middle connecting tube 72.

Each of the first positioning members 8 has a biasing section 81 disposed within the corresponding front lateral tube 61, and a projecting section 82 biased by the biasing portion 81 to project radially from the corresponding front lateral tube 61 into a selected one of the first and second positioning holes 512, 513 in the corresponding rear lateral tube 51. The biasing sections 81 are configured as reed springs, and are V-shaped. Each of the biasing sections 81 has a straight upper portion 811 connected fixedly to an inner wall surface of the annular wall 611 at an end thereof, and a straight lower portion 812 connected to the corresponding projecting section 82.

The seat member 21 is made of cloth to provide a comfortable touch feeling to the user, is disposed on the frame body unit 4, and has a seat portion 211 aligned with the front frame body 6, a backrest portion 212 aligned with the rear frame body 5, a rear coupling portion 213 for connecting the backrest portion 212 fixedly to the rear connecting tube 52, a front coupling portion 214 for connecting the seat portion 211 fixedly to the front connecting tube 62, and a middle coupling portion 215 attached to a junction between the seat portion 211 and a backrest portion 212 and connected to the middle connecting tube 72.

Each of the first locking units 22 includes a U-shaped mounting member 221 attached fixedly to an annular outer surface of the annular wall 511 of the corresponding rear lateral tube 51 and formed with a threaded hole 225 therethrough, and a bolt 22 having a head 226 and a threaded stem portion 227 engaging the threaded hole 225 and extending into a selected one of the front and rear through holes 612, 613 in the corresponding front lateral tube 61. As such, each of the rear lateral tubes 51 can be locked releasably on the corresponding front lateral tube 61 by the corresponding first locking unit 22.

Figure 5:
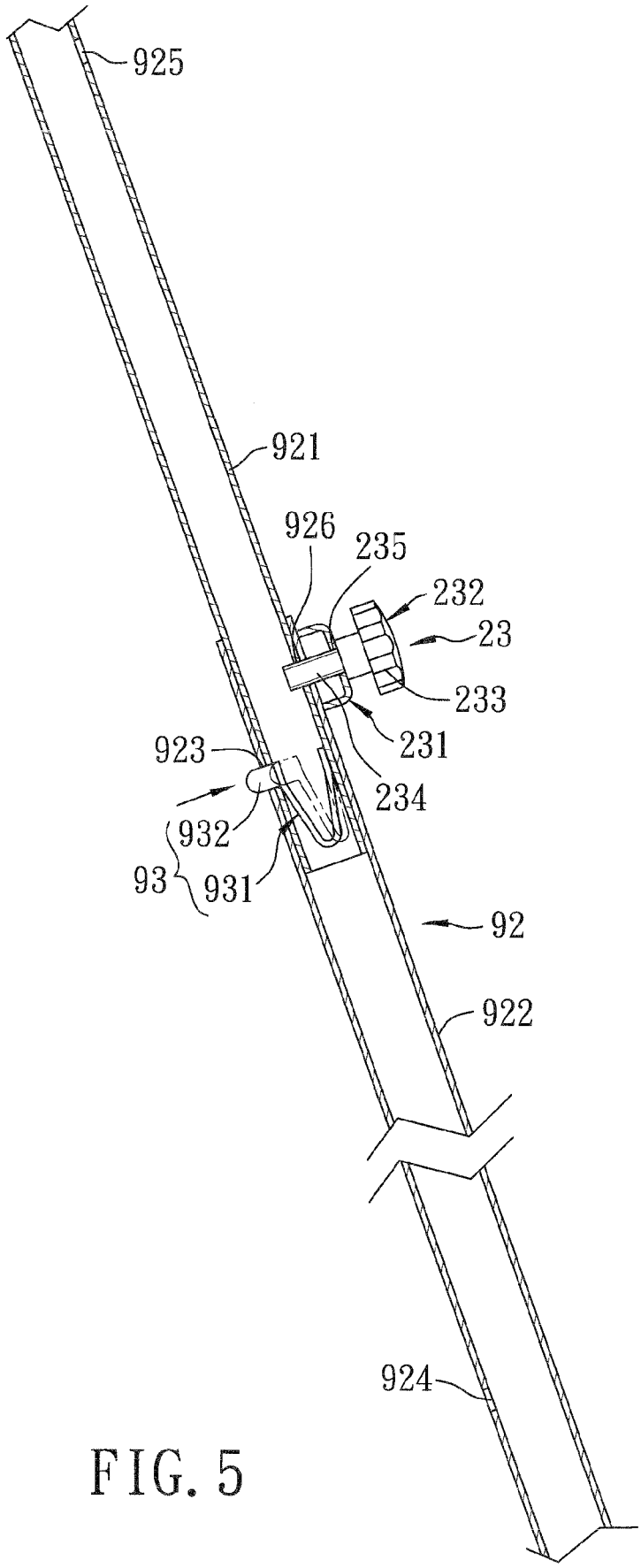
FIG. 5 is a fragmentary, partly sectional view of a rear swinging rod, a second positioning member, and a second locking unit of the preferred embodiment when the swinging mechanism is in the first state.

With further reference to FIG. 5, the suspending unit 9 includes a pair of front swinging rods 91 spaced apart from each other in the left-to-right direction for connecting the front frame body 6 swingably to the top frame 12 of the stationary seat 1, a pair of telescopic rear swinging rods 92 disposed behind the front swinging rods 91 and spaced apart from each other in the left-to-right direction for connecting the rear frame body 5 swingably to the top frame 12 of the stationary seat 1, and two second positioning members 93 disposed respectively within the rear swinging rods 92. The front swinging rods 91 are inclined forwardly and downwardly, and have a fixed length, upper ends hung on the top frame 12, and lower ends connected to the front frame body 6. The rear swinging rods 92 are inclined rearwardly and downwardly, and are adjustable in length, and have upper end hung on the top frame 12, and lower ends connected to the rear frame body 5. Each of the rear swinging rods 92 includes an upper tube 921 and a lower tube 922. The lower tubes 922 are sleeved respectively and movably on the upper tubes 921. Each of the lower tubes 922 has an upper positioning hole 923 and a lower positioning hole 924. Each of the upper tubes 921 has an upper through hole 925 and a lower through hole 926 that is spaced apart from the upper through hole 925 in an axial direction of the corresponding upper tube 921 by a distance that is equal to that between the upper and lower positioning holes 923, 924.

Each of the second positioning members 93 is disposed within the corresponding upper tubes 921, and has a biasing section 931 and a projecting section 932 biased by the biasing section 931 to project from the corresponding upper tube 921 into a selected one of upper and lower positioning holes 923, 924 in the corresponding lower tube 922. The second positioning members 93 are similar in construction to the first positioning members 8.

The second locking units 23 are similar in construction to the first locking units 22. That is, each of the second locking units 23 includes a mounting member 231 attached fixedly to an annular outer surface of the corresponding lower tube 922 and formed with a threaded hole 235 therethrough, and a bolt 232 having a head 233 and a threaded stem portion 234 engaging the threaded hole 235 and extending into a selected one of the upper and lower through holes 925, 926 in the corresponding upper tube 921 for locking releasably the corresponding upper and lower tubes 921, 922 on each other.

The covering 3 covers the top rods 122 for sun-shielding purposes.

Figure 6:
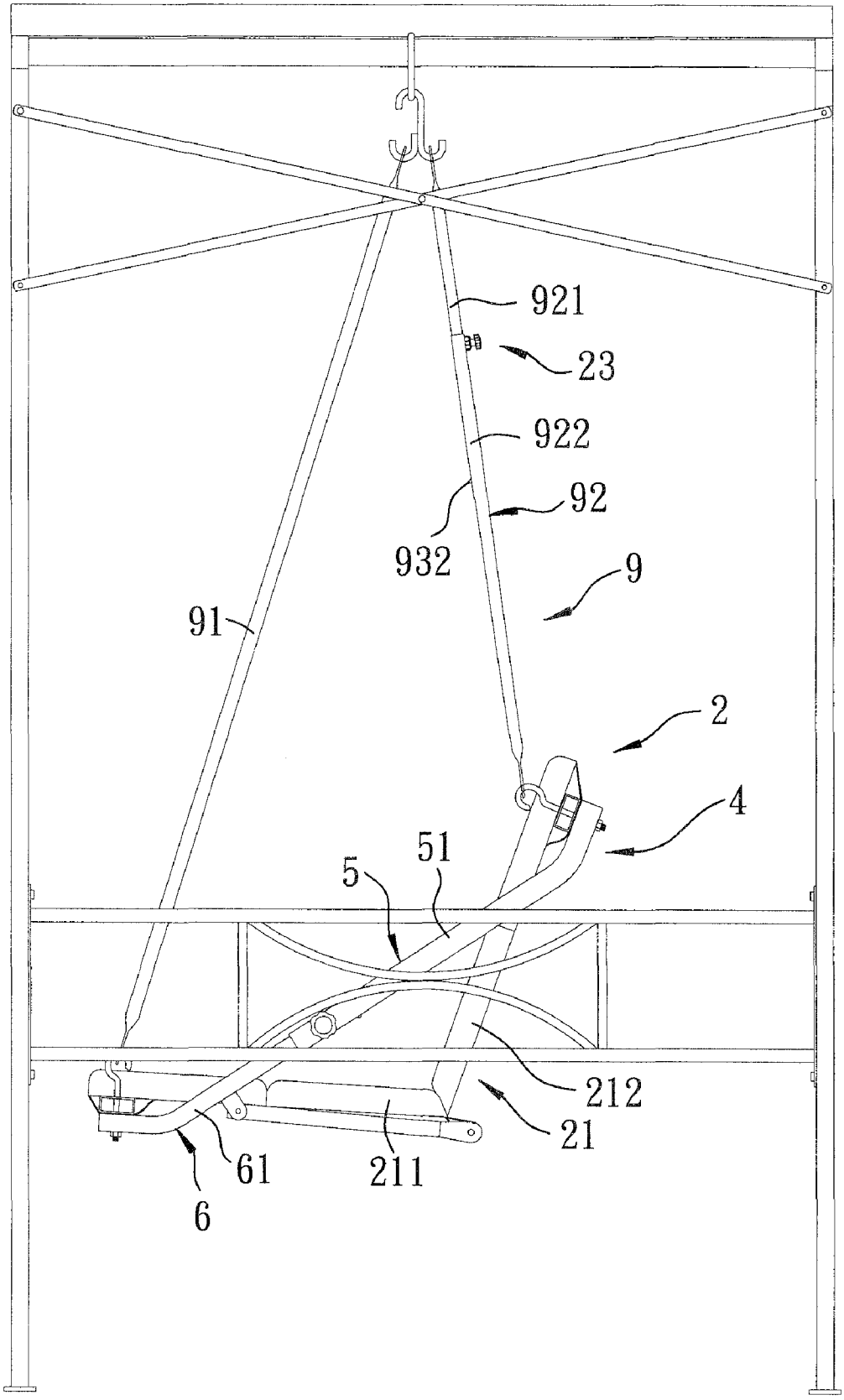
FIG. 6 is a side view of the preferred embodiment, illustrating the swinging mechanism in a second state.

The swinging mechanism 2 is changeable between a first state shown in FIG. 2 and a second state shown in FIG. 6.

When the swinging mechanism 2 is in the first state, with particular reference to FIG. 3, the first positioning members 8 extend respectively from the front lateral tubes 61 into the front positioning holes 512 in the rear lateral tubes 51, and, with particular reference to FIG. 4, the first locking units 22 extend respectively from the rear lateral tubes 51 into the rear through holes 613 in the front lateral tubes 61. As such, an assembly of the front and rear frame bodies 6, 5 has a large width in the front-to-rear direction. Also in the first state, with particular reference to FIG. 5, the second positioning members 93 extend respectively from the upper tubes 921 into the upper positioning holes 923 in the lower tubes 922, and the second locking units 23 extend respectively from the lower tubes 922 into the lower through holes 926 in the upper tubes 921. As such, the rear swinging rods 92 have a large length. In this state, the backrest portion 212 of the seat member 21 is aligned with the seat portion 211 in the front-to-rear direction to thereby allow a user to lie on the seat portion 211 and the backrest portion 212.

Figure 7:
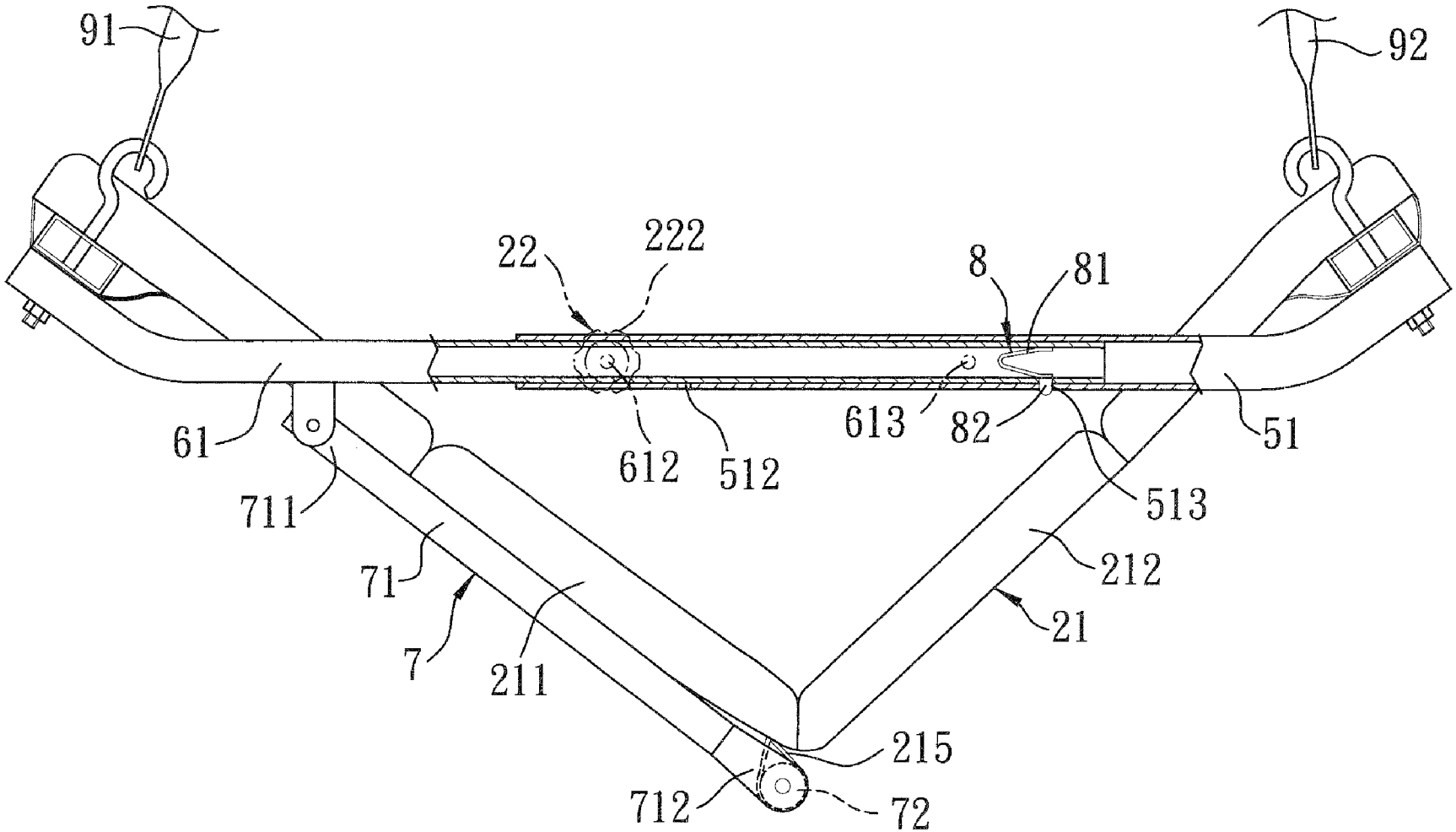
FIG. 7 is a fragmentary, partly sectional side view of the preferred embodiment when the swinging mechanism is in the second state.
Figure 8:
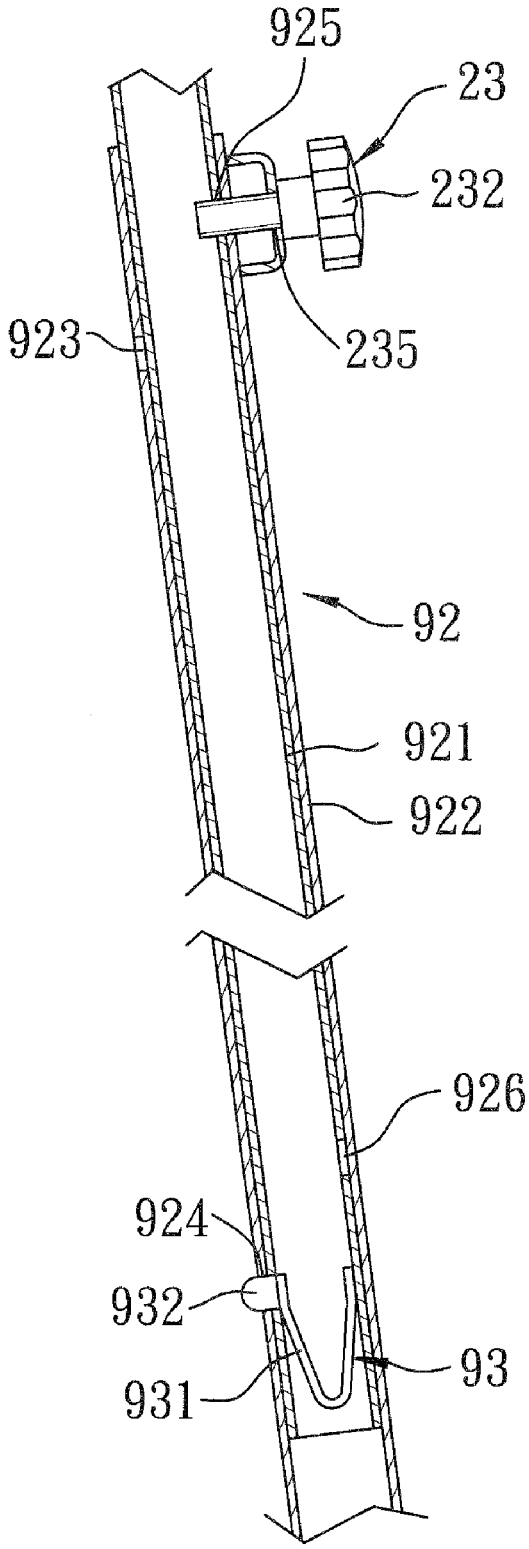
FIG. 8 is a fragmentary, partly sectional view of the rear swinging rod, the second positioning member, and the second locking unit of the preferred embodiment when the swinging mechanism is in the second state.

When the swinging mechanism 2 is in the second state, with particular reference to FIG. 7, the first positioning members 8 extend respectively from the front lateral tubes 61 into the rear positioning holes 513 in the corresponding rear lateral tubes 51, and the first locking units 22 extend respectively from the rear lateral tubes 51 into the front through holes 612 in the front lateral tubes 61. As such, the assembly of the front and rear frame bodies 6, 5 has a small width in the front-to-rear direction, that is smaller than the large width. Also in the second state, with particular reference to FIG. 8, the second positioning members 93 extend respectively from the upper tubes 921 into the lower positioning holes 924 in the lower tubes 922, and the second locking units 23 extend respectively from the lower tubes 922 into the upper through holes 925 in the upper tubes 921. As such, the rear swinging rods 92 have a small length that is smaller than the large length. In this state, the backrest portion 212 of the seat member 21 is inclined with respect to the seat portion 211 to thereby allow the user to sit on the seat portion 211 and lean back against the backrest portion 212.

When the swinging mechanism 2 is changed from the first state into the second state, the middle connecting tube 72 and the non-pivot ends 712 of the pivotable tubes 71 are moved away from the front and rear frame bodies 6, 5 so that the seat portion 211 and the backrest portion 212 of the seat member 21 are pivoted relative to each other to form a generally V-shaped configuration, as shown in FIG. 7.

In view of the above, through operation of the first and second positioning members 8, 93 and the first and second locking units 22, 23, the backrest portion 212 of the seat member 21 can be adjusted between a horizontal position and an inclined position.

With this invention thus explained, it is apparent that numerous modifications and variations can be made without departing from the scope and spirit of this invention. It is therefore intended that this invention be limited only as indicated by the appended claims.

I claim:

1. A swing device comprising:

a stationary seat including a pair of side frames spaced apart from each other in a left-to-right direction, and a top frame interconnecting upper ends of said side frames; and a swinging mechanism including a frame body unit swingable between said side frames and including a front frame body and a rear frame body that are interconnected telescopically, at least one first locking unit for locking releasably said front and rear frame bodies on each other, a suspending unit including a pair of front swinging rods spaced apart from each other in the left-to-right direction for connecting said front frame body swingably to said top frame of said stationary seat, and a pair of rear swinging rods disposed behind said front swinging rods and spaced apart from each other in the left-to-right direction for connecting said rear frame body swingably to said top frame of said stationary seat, each of said rear swinging rods including an upper tube and a lower tube that are interconnected telescopically, and at least one second locking unit for locking releasably said lower tubes of said rear swinging rods on said upper tubes of said rear swinging rods.

2. The swing device as claimed in claim 1, wherein said swinging mechanism further includes a seat member disposed on said frame body unit, said seat member having a seat portion connected fixedly to said front frame body, and a backrest portion connected fixedly to said rear frame body, said swinging mechanism being changeable between a first state, where an assembly of said front and rear frame bodies has a large width in a front-to-rear direction and said rear swinging rods have a large length such that a user can lie on said seat portion and said backrest portion, and a second state, where the assembly of said front and rear frame bodies has a small width in the front-to-rear direction smaller than said large width, and said rear swinging rods have a small length smaller than said large length such that the user can sit on said seat portion and lean back against said backrest portion.

3. The swing device as claimed in claim 2, wherein:

said front frame body includes a pair of front lateral tubes extending in the front-to-rear direction and spaced apart from each other in the left-to-right direction, and a front connecting tube extending in the left-to-right direction for interconnecting said front lateral tubes;

said rear frame body includes a pair of rear lateral tubes extending in the front-to-rear direction and spaced apart from each other in the left-to-right direction, and a rear connecting tube extending in the left-to-right direction for interconnecting said rear lateral tubes, said rear lateral tubes being sleeved respectively and movably on said front lateral tubes;

said swinging mechanism further includes a pivotable frame body connected to said front frame body of said frame body unit, said pivotable frame body including a pair of pivotable tubes extending in the front-to-rear direction and spaced apart from each other in the left-to-right direction, and a middle connecting tube extending in the left-to-right direction for interconnecting said pivotable tubes, each of said pivotable tubes having a pivot end connected pivotally to a respective one of said front lateral tubes, and a non-pivot end opposite to said pivot end and connected to said middle connecting tube; and said seat member further includes a front coupling portion for connecting said seat portion fixedly to said front connecting tube, a rear coupling portion for connecting said backrest portion fixedly to said rear connecting tube, and a middle coupling portion attached to a junction between said seat portion and said backrest portion of said seat member and connected to said middle connecting tube such that, when said swinging mechanism is changed from the first state into the second state, said middle connecting tube and said non-pivoted ends of said pivotable tubes are moved away from said front and rear frame bodies.

4. The swing device as claimed in claim 1, wherein said front frame body includes a pair of front lateral tubes, and a pair of positioning members, and said rear frame body includes a pair of rear lateral tubes sleeved respectively and movably on said front lateral tubes, each of said rear lateral tubes having a pair of positioning holes, each of said positioning members being disposed within a corresponding one of said front lateral tubes and having a projecting portion biased to project from the corresponding one of said front lateral tubes into a corresponding one of said positioning holes in a corresponding one of said rear lateral tubes when said swinging mechanism is in a corresponding one of the first and second states.

5. The swing device as claimed in claim 4, wherein:

each of said front lateral tubes has two through holes spaced apart from each other by a distance that is equal to that between said positioning holes in each of said rear lateral tubes; and said swing device comprises two said first locking units each locking releasably a corresponding one of said rear lateral tubes on a corresponding one of said front lateral tubes, each of said first locking units including a mounting member attached fixedly to an annular outer surface of the corresponding one of said rear lateral tubes and formed with a threaded hole therethrough, and a bolt engaging said threaded hole in said mounting member and extending into a selected one of said through holes in the corresponding one of said front lateral tubes.

6. The swing device as claimed in claim 1, wherein said lower tubes are sleeved respectively and movably on said upper tubes, each of said lower tubes having a pair of positioning holes, said swinging mechanism further including a pair of positioning members, each of said positioning members being disposed within a corresponding one of said upper tubes and having a projecting portion biased to project from the corresponding one of said upper tubes into a corresponding one of said positioning holes in a corresponding one of said lower tubes when said swinging mechanism is in a corresponding one of the first and second states.

7. The swing device as claimed in claim 6, wherein:

each of said upper tubes has two through holes spaced apart from each other by a distance that is equal to that between said positioning holes in each of said lower tubes; and said swing device comprises two said second locking units each locking a corresponding one of said lower tubes on a corresponding one of said upper tubes, each of said second locking units including a mounting member attached fixedly to an annular outer surface of the corresponding one of said lower tubes and formed with a threaded hole therethrough, and a bolt engaging said threaded hole in said mounting member and extending into a selected one of said through holes in the corresponding one of said upper tubes.

8. The swing device as claimed in claim 1, wherein:

each of said side frames of said stationary seat includes two upright rods spaced apart from each other in a front-to-rear direction, and at least one side connecting rod for interconnecting said upright rods; and said top frame includes two transverse rods each extending in the left-to-right direction for interconnecting upper ends of two corresponding ones of said upright rods, and a plurality of top rods each connected between said transverse rods.

9. The swing device as claimed in claim 1, wherein:

said swinging mechanism further includes a seat member disposed on said frame body unit, said front frame body includes a pair of front lateral tubes;

said rear frame body includes a pair of rear lateral tubes sleeved respectively and movably on said front lateral tubes; and said swinging mechanism is changeable between a first state, where an assembly of said front and rear lateral tubes has a large width in the front-to-rear direction and said rear swinging rods have a large length such that a user can lie on said seat member, and a second state, where the assembly of said front and rear lateral tubes has a small width in the front-to-rear direction smaller than the large width, and said rear swinging rods have a small length smaller than said large length such that the user can sit on and lean back against said seat member.

* * * * *